United States Patent [19]

Greenblatt

[11] 4,447,921

[45] May 15, 1984

[54] SOFA BED WITH CONTOURED MATTRESS

[76] Inventor: Julius Greenblatt, 7572 York Dr., Clayton, Mo. 63105

[21] Appl. No.: 389,411

[22] Filed: Jun. 17, 1982

[51] Int. Cl.[3] ..... A47C 17/00

[52] U.S. Cl. ..... 5/12 R; 5/69; 5/13

[58] Field of Search ..... 5/12 R, 13, 51 D, 51 E, 5/66, 69, 411, 446, 447, 443; 297/284

[56] References Cited

U.S. PATENT DOCUMENTS

| | | | |
|---|---|---|---|
| 1,377,605 | 5/1921 | Starks | 5/69 |
| 1,452,915 | 4/1923 | Kennedy | 5/90 |
| 2,147,538 | 2/1939 | Maguire | 5/411 |
| 2,359,510 | 10/1944 | Chapman | 5/90 |
| 3,165,757 | 1/1965 | Rogers, Jr. | 5/13 |
| 3,380,082 | 4/1968 | Mikos | 5/12.12 |
| 3,762,769 | 10/1973 | Poschl | 297/284 |
| 3,987,504 | 10/1976 | Fox | 5/69 |
| 4,307,477 | 12/1981 | Jacobsen | 5/90 |

*Primary Examiner*—Alexander Grosz
*Assistant Examiner*—Michael F. Trettel
*Attorney, Agent, or Firm*—Gravely, Lieder & Woodruff

[57] ABSTRACT

This application relates to an articulated sofa bed construction in which a bar is pivotally attached to the frame at the location where the knees of the user are located when the sofa bed is in bed defining position so that the bar can be raised beneath the mattress to form a knee supporting hump in the bed. The application also relates to a spring tie down construction to prevent the mattress supporting fabric from exerting undue pressure on the head section of the frame when it is in its raised head supporting reading position.

4 Claims, 6 Drawing Figures

SOFA BED WITH CONTOURED MATTRESS

BACKGROUND OF THE INVENTION

This invention relates to improvements in furniture of the sofa bed type in which a foldable bed frame mechanism is operatively mounted in a sofa frame to fold outwardly when used as a bed and to fold inwardly in a compact manner to form the seat when used as a sofa.

Sofa bed constructions of the type exemplified usually employ a foldable polyurethane foam or innerspring mattress laid over a link fabric which is connected by helicals of coil springs to an articulated foldable frame. The head support section of the frame usually is lockable in an inclined upright position thereby allowing the user to lie on the device with the head and shoulders raised when it is in bed defining position so as to better read, watch television, etc.

It is an important object of the present invention to provide a means for raising the knees of the user so as to provide additional comfort and relaxation for the user when the device is in bed defining position.

It is a further object to provide a swingable bar pivotably attached to the frame and movable from a flat position adjacent to the mattress supporting fabric to a raised position against a stop, thereby forming a knee supporting hump in the mattress.

Still another object of this invention is to provide a tie means for the mattress supporting fabric to anchor the fabric to a frame cross member intermediate the ends of the fabric, thereby minimizing pressure from the fabric to the raised head section of the frame, which pressure has a tendency to urge the frame head section into flat position.

These and other objects and advantages will become apparent hereinafter.

There are earlier patents which disclose raised mattresses, but their devices usually have complicated mechanisms for raising or lowering the mattresses, or are not associated with a sofa bed configuration. Among these are Bartz U.S. Pat. No. 3,636,573 which shows a hospital bed with raisable head and intermediate sections; Woolley U.S. Pat. Nos. 2,567 and Shields 167,700 which show invalid beds or lounges with raisable head and intermediate sections; McLaughlin U.S. Pat. No. 1,639,462 which shows a foot end mattress adjusting apparatus; Fox U.S. Pat. No. 3,987,504 which shows a cot having webbing on a frame of which the head and intermediate sections can be raised and lowered; and Starks U.S. Pat. No. 1,377,605 which shows a reclining chair having a movable head section and means for raising a mattress beneath the knee area.

The present invention comprises a rotatable bar movable from a flat position to an over center raised position to raise a sofa bed mattress beneath the knee area of one laying on the bed. The invention further comprises means for restraining a woven spring supported fabric on an articulated sofa bed frame from applying undue pressure to a raised head section of the frame. The invention also consists in the parts and mechanisms of the embodiment disclosed herein and set forth in the claims which form part of the specification.

In the drawings wherein like numbers refer to like parts wherever they occur;

DETAILED DESCRIPTION

Figure 1:
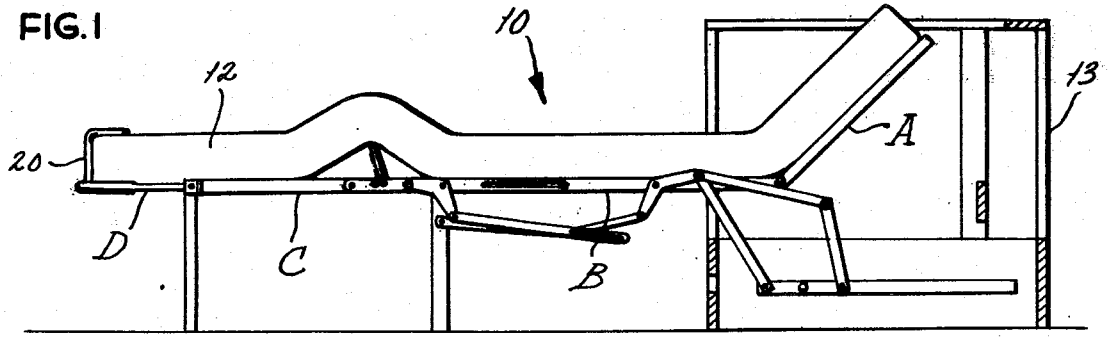
FIG. 1 is a side elevational view of the sofa bed frame in open bed defining position with the knee and head supports in raised position.
Figure 2:
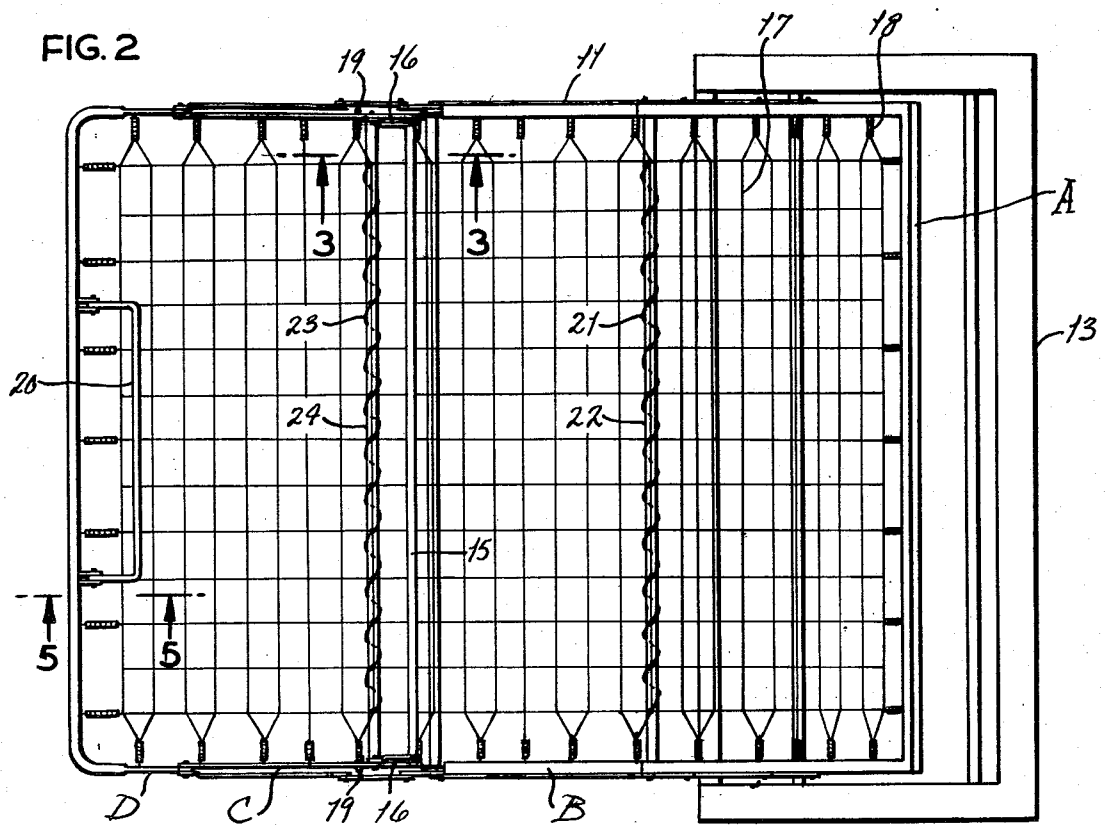
FIG. 2 is a top plan view of the sofa bed in bed defining position with the knee and head supports in flat position.

FIGS. 1 and 2 show a foldable sofa bed 10 in bed defining position, with FIG. 2 showing the bed frame 11 in a completely flat position with the mattress 12 removed.

The bed frame 11 is articulated and foldable into a sofa frame 13 when in seat supporting sofa defining position (not shown). The bed frame 11 consists of a head section A, two intermediate sections B and C, and a foot section D. The sections A, B, C and D are foldable into sofa defining position and fit within the upholstered sofa frame 13. The mattress 12 is conventionally folded within the frame 11 when in sofa defining position. All of this is conventional in the sofa bed art and any of several conventional bed frame and sofa frame constructions known to the art are suitable for use with this invention. Therefore this portion of the sofa bed construction will not be described in great detail as it is well known to those working in this art.

The unique aspects of the present invention includes a rotatable bar 15 connected to the intermediate frame section C by links 16 at each end thereof. The bar 15 normally resides within the bed frame section C and is positioned above the woven fabric 17 which is connected to the frame members A, B, C and D by helicals 18.

Figure 3:
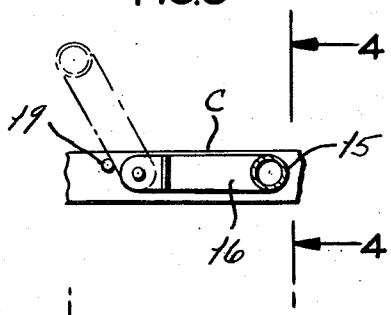
FIG. 3 is a fragmentary sectional view taken along line 3—3 of FIG. 2.
Figure 4:
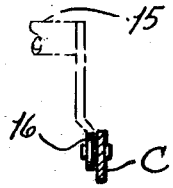
FIG. 4 is a fragmentary sectional view taken along line 4—4 of FIG. 3.
Figure 5:
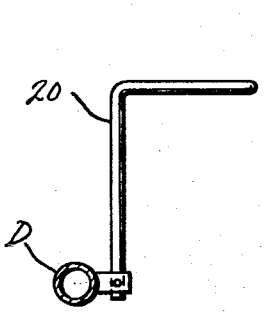
FIG. 5 is a fragmentary sectional view taken along line 5—5 of FIG. 2.
Figure 6:
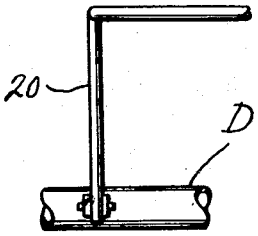
FIG. 6 is a fragmentary sectional view taken along line 6—6 of FIG. 5.

The links 16 are pivotally connected to the frame C at one end and the other end carries the bar 15. A stop member 19 engages the bar 15 after it is passed over the vertical center of the pivotal connections of the link 16 to the frame C and stops the bar in the inclined position shown in FIG. 1 and indicated by the broken lines of FIG. 3.

The bar 15 is moved manually to this position to raise the mattress 12 and form a lateral hump therein approximately at the area beneath the knee area of a person reclining on the opened bed.

A clip 20 or mattress stop fits around the foot end of the mattress 12 and is fixed to the foot frame section D to hold the foot end of the mattress 12 is fixed position.

The head frame member A is movable to the inclined position shown in FIG. 1 and is assisted in being retained there by the application of a tie wire 21 around the fabric links and also around a lateral frame member 22. This prevents the weight of the person reclining on the bed 10 from applying pressure to the inclined head section A through the fabric 17 tending to move the frame member A from its inclined position.

A second tie wire 23 is applied to the fabric 17 and a second lateral support frame member 24 at the intermediate frame section C to anchor the fabric 17 to the sofa frame 11.

In operation, the head frame A merely is lifted to its inclined position where it automatically locks in place and the user reaches under the mattress 12 and manually rotates the bar 15 from its resting position counterclockwise (as indicated by the arrow in FIG. 3) until the links 16 engage the stop 19. The sofa bed then is ready for use with a raised portion for the head rest and a raised portion beneath the knees to provide additional relaxation.

What is claimed is:

1. In an articulated foldable sofa bed construction movable from an extended bed defining position to a folded seat supporting position including relatively movable side frame sections, a fabric stretched between said frame members and connected thereto by spring members, and a mattress supported on said fabric, the improvement comprising a lateral bar extending across the width of the sofa bed construction between opposed side frame members between the fabric and the mattress and having each end connected to one of said side frame members by links which carry the bar from a position recessed between said side frame members to a raised position extending above said side frame members, so as to raise a section of the mattress when said bar is moved to its raised position, said raised mattress section providing support for the knees of the user.

2. The construction of claim 1 including means for retaining the foot end of the mattress within the frame.

3. The construction of claim 1 including stop means for the bar; said stop means being positioned on the side frame members to engage the links after the bar has been rotated past the center line of the connection of the links to the side frames.

4. The construction of claim 1 wherein the frame includes a movable head section which can be raised to raise the head of the user and including a cross member between the side frames where the head section joins the remainder of the frame and means for tying the fabric to the said cross member.

* * * * *